US006805057B2

(12) United States Patent
Carr et al.

(10) Patent No.: US 6,805,057 B2
(45) Date of Patent: Oct. 19, 2004

(54) BULLET FOR OPTIMAL PENETRATION AND EXPANSION

(75) Inventors: Douglas W. Carr, Plymouth, MN (US); Lawrence P. Head, Cedar, MN (US)

(73) Assignee: Federal Cartridge Corporation, Anoka, MN (US)

( * ) Notice: Subject to any disclaimer, the term of this patent is extended or adjusted under 35 U.S.C. 154(b) by 71 days.

(21) Appl. No.: 10/007,604

(22) Filed: Nov. 7, 2001

(65) Prior Publication Data

US 2002/0056397 A1 May 16, 2002

Related U.S. Application Data

(60) Provisional application No. 60/246,956, filed on Nov. 10, 2000.

(51) Int. Cl.[7] ..... F42B 12/34

(52) U.S. Cl. ..... 102/509; 102/507

(58) Field of Search ..... 29/1.2, 1.22, 1.23; 102/506, 507, 508, 509, 510, 514, 515, 516, 1

(56) References Cited

U.S. PATENT DOCUMENTS

| | | | | |
|---|---|---|---|---|
| 1,059,213 A | | 4/1913 | Ross | |
| 1,095,501 A | | 5/1914 | Hoagland | |
| 1,135,357 A | | 4/1915 | Clyne | |
| 1,556,160 A | | 11/1925 | Riggs | |
| 1,833,127 A | | 11/1931 | Rinkel | |
| 2,045,964 A | | 6/1936 | Rinkel | |
| 2,123,981 A | | 7/1938 | Whipple | |
| 2,327,950 A | | 8/1943 | Whipple | |
| 2,765,738 A | | 11/1956 | Frech, Jr. | |
| 3,003,420 A | | 11/1961 | Nosler | |
| 3,157,137 A | | 11/1964 | Burns, Jr. | |
| 4,044,685 A | | 8/1977 | Avein | |
| 4,245,557 A | | 1/1981 | Knappworst et al. | |
| 4,550,662 A | * | 11/1985 | Burczynski | 102/509 |
| 4,655,140 A | | 4/1987 | Schirneker | |
| 4,836,110 A | * | 6/1989 | Burczynski | 102/508 |
| 4,882,822 A | * | 11/1989 | Burczynski | 86/54 |
| 4,947,755 A | * | 8/1990 | Burczynski | 102/506 |
| 5,079,814 A | * | 1/1992 | Moore et al. | 86/55 |
| 5,101,732 A | | 4/1992 | Schluckebier | |
| 5,131,123 A | | 7/1992 | Brooks | |
| 5,259,320 A | | 11/1993 | Brooks | |
| 5,528,990 A | * | 6/1996 | Corzine et al. | 102/514 |
| 5,641,937 A | * | 6/1997 | Carter | 102/507 |
| 5,811,723 A | | 9/1998 | Stone | |
| 6,257,149 B1 | * | 7/2001 | Cesaroni | 102/515 |
| 6,305,292 B1 | * | 10/2001 | Burczynski et al. | 102/507 |

FOREIGN PATENT DOCUMENTS

DE 3822775 A1 * 2/1990 ..... B23P/15/20

* cited by examiner

*Primary Examiner*—Jack Kam
*Assistant Examiner*—Troy Chambers
(74) *Attorney, Agent, or Firm*—Vidas Arrett & Steinkraus, P.A.

(57) ABSTRACT

A bullet for law enforcement and personal defense use capable of meeting current FBI and IWBA standards and comprised of a jacket of malleable metal having a cylindrical side wall, tapered nose portion, an open forward end, and a plurality of deep longitudinally extending scores formed in the nose portion and defining petals therebetween which extend rearwardly from its mouth, and a malleable core mounted within the jacket and having a plurality of separate segments extending forwardly from its cylindrical base into the nose portion of the jacket and terminating adjacent said open jacket end in a shallow hollowed point, the bullet being capable of piercing substantial barrier materials before entering its target and thereafter expanding radially to about 1.5–2.0 times its diameter, while traveling 9–16 inches within its target.

23 Claims, 3 Drawing Sheets

BULLET FOR OPTIMAL PENETRATION AND EXPANSION

CROSS REFERENCE TO RELATED APPLICATIONS

This application is an application for a patent which is also disclosed in Provisional Application Ser. No. 60/246,956, filed on Nov. 10, 2000 by the same inventors, namely, Douglas W. Carr and Larry P. Head, and entitled "IMPROVED PENETRATION AND EXPANSION BULLET", the benefit of the filing date of which is hereby claimed.

BACKGROUND OF THE INVENTION

This invention relates to the development of improved penetration and expansion bullets for law enforcement and personal defense use. It is particularly related to the development of a hollow-point bullet intended for law enforcement use and personal defense and which exhibits optimum penetration and more reliable and consistent expansion than prior art hollow-point bullets, while maintaining near 100% weight retention, when fired through barrier materials such as wall board, plywood, sheet metal and heavy clothing before entering its primary target.

Any material encountered by the bullet before it reaches its intended target is referred to as a barrier material. Heavy clothing, sheet steel, wall board (gypsum board), plywood, or automobile glass would all be considered to constitute barrier materials because they tend to plug the cavity of the hollow-point so as to preclude the collection of viscous materials therein. Such viscous materials induce expansion which functions to slow down the bullet, maximize wound volume, and greatly reduce penetration. If the cavity of the conventional hollow-point bullet is filled with barrier material before it reaches its target, the bullet will tend to over-penetrate and frequently pass entirely through the target, thereby minimizing its desired effectiveness and endangering unintended targets.

In December of 1988, the Federal Bureau of Investigation Firearms Training Unit designed and implemented a special test protocol for evaluating effectiveness of modem ammunition, using various types of bullets. Each cartridge and bullet type submitted for testing was used in eight (8) different test events. All of the tests ultimately entailed the penetration of blocks of 10% ballistic gelatin, with or without intermediate barriers in front of the gelatin. These tests included firing bullets into bare gelatin at a distance of ten (10) feet, and through the following materials placed in front of the gelatin: heavy clothing, sheet steel, wall board (gypsum board), plywood and automobile glass. Tests were also conducted with heavy clothing at twenty (20) yards, and automobile glass at twenty (20) yards.

The Federal Bureau of Investigation (FBI) does not have a specific requirement for bullet expansion; however, the extent of bullet penetration is a closely controlled parameter. The FBI desires ammunition that penetrates at least 12 inches in 10% ballistic gelatin while not penetrating more than 18 inches. This depth of bullet penetration is desired regardless of what intermediate barriers are encountered by the bullet.

The FBI protocol is the most stringent test protocol ever devised for bullets. Many of the ammunition manufacturers soon discovered that the hollow-point bullets, which they had at that time, produced very poor results in 10% ballistic gelatin after passing through barriers. Even today, many of the best hollow-point bullets available perform only marginally well when tested using the FBI protocol.

Since the establishment of the FBI special testing protocol, the International Wound Ballistics Association (IWBA) has carried out further work. The IWBA has defined what it believes to be the ideal performance for bullets used for personal defense and law enforcement.

The IWBA has stated that, unlike the FBI, only two (2) terminal performance tests are necessary for evaluating ammunition. These two (2) tests are the bare gelatin test (identical to the FBI testing protocol), and an additional test consisting of shooting through four (4) layers of denim, continuing into a block of calibrated 10% ordnance gelatin. The IWBA has specified that terminal ballistics penetration in the bare gelatin should have a mean value of no less than 13 inches and no more than 14.0 inches. Further, the IWBA specifies that mean penetration in gelatin after passing through four (4) layers of denim should be no less than 12.5 inches and no more than 16.0 inches. In general, the IWBA requirement can be said to be within the range of 12.5–16 inches of penetration.

The four (4) layer denim test is an especially difficult test for current handgun ammunition. The denim will retard the expansion of most bullets by plugging the hollow-point cavity. This results in an unexpanded bullet. Such a bullet will over-penetrate its target, thereby threatening unintended targets and also failing to maximize the damage to the intended target. Many police departments have adopted the standards set by the IWBA, and much effort has been expended by ammunition manufacturers to create bullets that meet the IWBA's ideal performance specifications.

Yet another standard for bullet performance has been established by the Immigration and Naturalization Service (INS). The INS has set a standard minimum depth of penetration at 9 inches in base gelatin. This reduced standard of penetration can be achieved with a bullet that expands to a greater extent, therefore slowing the bullet more and reducing the penetration to near nine (9) inches.

BRIEF SUMMARY OF THE INVENTION

The design of our bullet is characterized by a series of elements which enable the bullet to expand after passing through intermediate barriers. These elements also allow the bullet to penetrate to the ideal depth of 12–16 inches in bare gelatin or minimum of 9 inches of penetration, depending on the standard used. While doing so, the bullet expands to between about 1.5–2.0 times its original diameter. It also retains near 100% of its weight.

Our preferred bullet is comprised of a jacket of malleable metal, such as one formed predominately of copper or copper alloy, and an inner core of lead or lead alloy. The bullet exterior is conventionally shaped. The front portion has a radiused or tapered open ended nose, and the rear portion has a rearward cylindrically shaped side wall.

The jacket encloses the lead core, except at the front-most portion which contains a hollow-point cavity in the core. The hollow-point cavity is conically shaped with an angle of 30–50 degrees, when measured from the axis of the bullet. Such an angle provides for a relatively shallow hollow-point cavity compared to conventional hollow-point bullets.

The prior art hollow point bullet has a relatively deep cavity in the nose which is defined by a straight cylindrically shaped wall which extends parallel to the longitudinal axis of the bullet. Often, the bottom of the cavity is conically shaped. The diameter of the mouth of the cavity is typically 0.50–0.70 times the diameter of the bullet.

The cavities in our hollow point bullets are of generally conical shape and the cavity-defining wall of each extends outwardly to the periphery at an angle of about 30–50 degrees to the longitudinal axis of the bullet. The larger the angle between the cavity wall and the longitudinal axis of this bullet, the more shallow will be the cavity, and the greater the tendency will be for the barrier material to slip radially outwardly therefrom, since the outward slope of the cavity wall will be more gentle. The smaller the angle, the steeper the slope will be toward the circumference of the bullet and the lesser the tendency will be for barrier material to slip radially outwardly. As the cavity wall approaches being parallel to the longitudinal axis of the bullet, the barrier material increasingly collects and remains within the cavity to a greater degree and tends to plug up the cavity, thereby increasingly blocking entrance of viscous material into the cavity and consequently minimizing expansion of the bullet.

The configuration of the hollow-point cavity serves two (2) purposes. First, it prevents clogging of the hollow-point cavity by allowing at least a portion of any picked-up barrier material to be wiped away by the target material as the bullet enters the target. This enables expansion after passing through the barrier material and entering the target, because it permits the cavity to receive and retain viscous materials readily available throughout the body of the target. Conventional hollow-points, having deep and nearly straight-walled cavities extending substantially parallel to the longitudinal axis of the jacket, become plugged with barrier materials which minimizes the amount of viscous material which may enter the cavity and thereby prevents adequate expansion. Secondly, the shape of our hollow-point cavity provides for a low thickness of lead and copper between the hollow-point cavity and exterior of the bullet. It appears that reducing the thickness of this area will reduce the amount of hydraulic pressure needed in the hollow-point cavity to induce expansion.

The nose portion of our jacket has a number of equally spaced deep scores which extend from the leading edge rearwardly and generally parallel to the longitudinal axis of the bullet, to an optimum length determined by terminal testing. The external scoring of the jacket allows the jacket to be deformed by hydraulic pressure within the hollow-point cavity, with a minimum of force. Such a force is readily generated by the liquid or flesh of the target, because the cavity of the hollow-point will be relatively free of barrier material.

A further element which reduces the amount of hydraulic force necessary to expand the bullet is preforming of the lead core. The forward or leading portion of the lead core is formed into multiple, physically separated, equally spaced segments or wedges, the sides of which extend from the bullet center in a radial direction perpendicular to the longitudinal axis of the bullet, as shown in FIG. 7. The wedge-shaped core segments are swaged together and comprise the forward end portions of the lead core. They extend from the hollow-point cavity in the front end to a point near the longitudinal middle of the bullet. The length of the segmental sections are optimized so that the bullet expands at and after it enters its target to a diameter which results in an optimum penetration depth in bare gelatin of 12.5–16 inches, which is the preferred depth of penetration according to FBI and IWBA standards, or a minimum of nine (9) inches for INS standards.

The preforming of the lead into wedge-shaped segments weakens the lead core in the front portion of the bullet. The weakening of the core reduces the amount of hydraulic pressure needed to expand the bullet. The physically separated wedge-shaped segments, when swaged into the tapered nose portion of the bullet, retain at least some of their individualized characteristics, so that they will readily separate when the subsequent substantial expansion takes place as the bullet moves along within the target, to the depth of 12.5–16 inches. Our bullet, which requires less hydraulic pressure to expand, will penetrate through difficult intermediate barriers, yet still expand when a conventional bullet will not.

Our bullet's copper jacket has a different thickness throughout its length from front to rear. The jacket is relatively thin at its front end near the mouth of the hollow cavity, to readily sever, and thereby facilitate early expansion. This provides the thin hoop of material around the nose which readily severs, as referred to above. The jacket tapers toward its cylindrical wall to over double the thickness of the jacket material at the mouth of the tapered portion of the jacket. The weakened elements of the jacket construction causes the jacket to be sufficiently weak to encourage expansion and to be sufficiently strong after penetration of the target, to ensure structural integrity and weight retention. A conventional bullet which expands easily, is in danger of over-expansion and weight loss, the latter due to pieces of the bullet breaking off while expanding.

While moving within the target, each of the petals of the jacket fold back along the body 10 of the bullet in an arc that supports a segment of the lead core which also expands outwardly from the hollow-point cavity. This results in each of the above segments resting upon a petal or panel of the jacket, which has been defined previously by deep scoring. These petals remain intact as part of the spent bullet, between the cylindrical portion of the jacket and the expanded segment of the lead core.

The construction of our jacket also provides improved performance after the bullet has passed through barrier material such as steel sheet metal (as used in the construction of automobile bodies). After passage through the steel barrier and upon entering the target, the bullet jacket and core bulge and expand. In our bullet the bulging of the core and jacket is to a higher degree than conventional hollow-point bullets, because of the freedom with which the segments can separate from each other, due to the retention of at least some of their individual body characteristics. The deep scoring of the jacket causes the petals to separate and does not prevent the lead core from expanding slightly. This increased expansion within the target provides for a larger wound profile and prevents over penetration of the target.

The above-described bullet will expand and penetrate in 10% ballistic gelatin to meet the ideal specifications set by the FBI and the IWBA of 12.5–16 inches of penetration in bare gelatin. The bullet provides the additional advantage of virtually 100% weight retention and expansion amounting to 1.5–2.0 times the original diameter of the bullet before being fired. This bullet will penetrate through intermediate barriers of wall board, plywood, heavy clothing and denim, to thereafter expand and penetrate to ideal parameters. The bullet will also provide improved performance through automobile sheet metal as described hereinbefore. If necessary to meet the alternative INS standard of 9 inches of penetration, the bullet core may be preformed with segments extending to a greater extent, so as to produce a greater expansion and consequent lesser penetration.

DETAILED DESCRIPTION OF THE INVENTION

Figure 1:
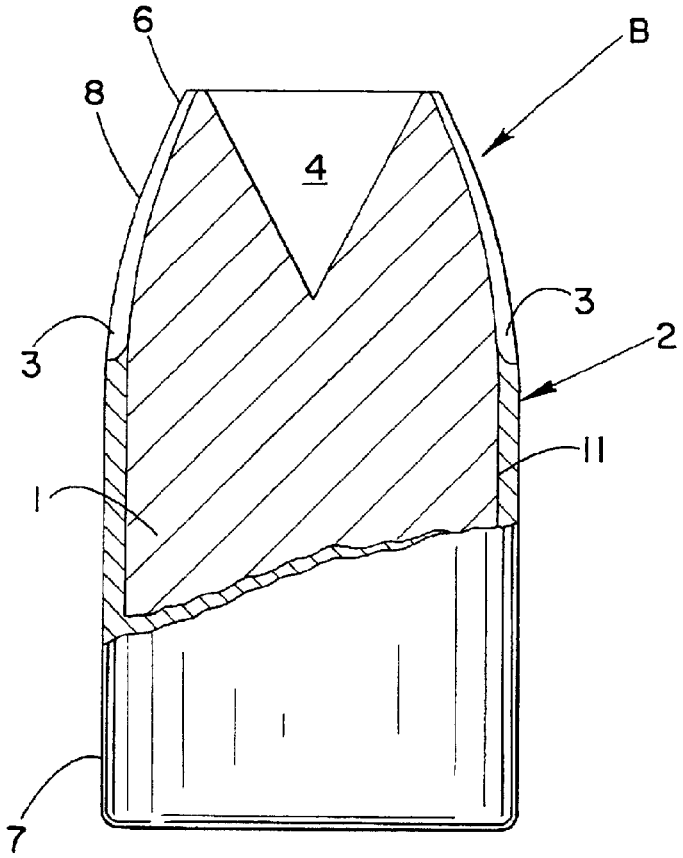
FIG. 1 is a side elevational view of our bullet, with a portion thereof shown in vertical section.

FIG. 1 shows our bullet B, its cylindrical base portion 7 and a tapered front portion or ogive 8. The copper alloy bullet jacket 2 has a cylindrical wall at the rear portion 7 of the bullet. The thickness of the jacket decreases toward the leading edge 6 of the bullet. The bullet jacket 2 is scored deeply as at 3, along the front portion or ogive 8 of the bullet B for more than half the length of the ogive 8. The scoring 3 in the jacket is longitudinal relative to the longitudinal axis of the bullet B and is equally spaced around the circumference of the bullet. These scores 3 define jacket petals or panels 10 therebetween at the forward end of the jacket and are shown as being six (6) in number.

Figure 2:
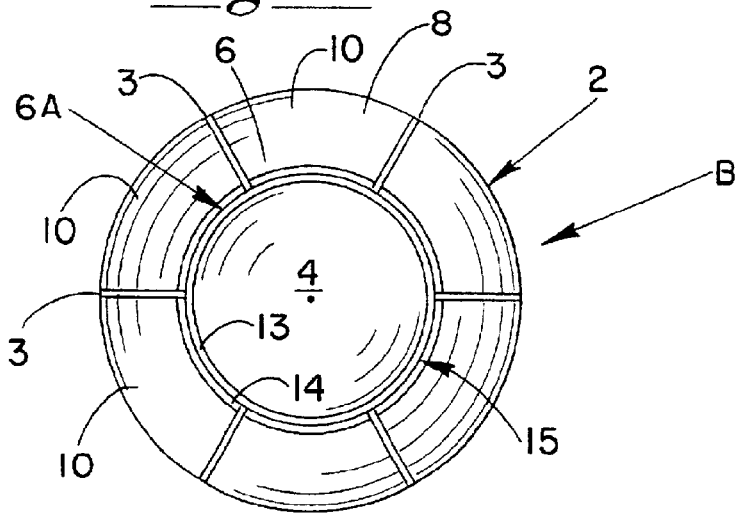
FIG. 2 is a top plan view of the same bullet.

The leading edge 6 of the bullet B is comprised of a relatively thin and weak hoop 6A of lead and copper alloy material that is easily severed upon impact with the target. The front edge 13 of the core material which defines the open mouth, terminates opposite the front edge 14 of the petals 10, the latter edge being disposed outwardly of edge 13, as shown in FIG. 2.

The jacket 2 contains a core 1 of malleable material, such as lead, which extends from the rear portion 7 of the bullet into the front portion 8. The bullet core 1 is formed in the nose portion 8 to provide longitudinally extending, physically separate, wedge-shaped core segments 5 which extend forwardly from the solid non-segmented cylindrically shaped base portion 11 of the core. The separate wedge-shaped core segments 5 include radially extending weakening planes 9 which are compressed by swaging to form the shallow hollow-point 4.

The jacket 2 may be formed principally of one or more of a group of materials which includes copper, brass, tin, aluminum, tungsten, zinc, steel, iron, or alloys thereof. The core 1 may be made principally of materials taken from a group which includes lead, tungsten, tin, zinc, polymers, or alloys thereof.

Figure 4:
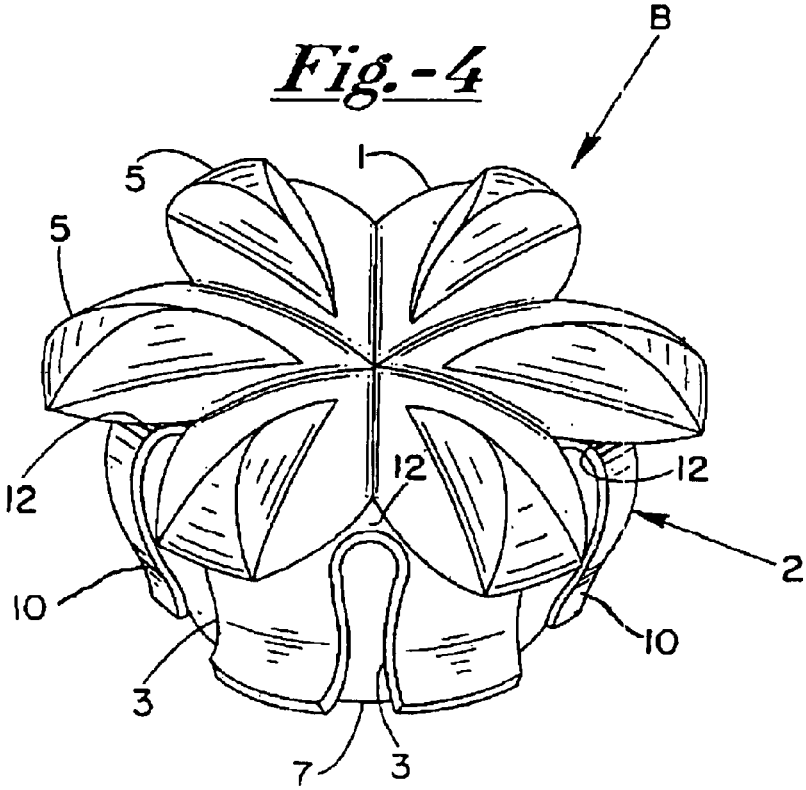
FIG. 4 is a perspective view from the side and above of the fully expanded bullet shown in FIG. 3.
Figure 5:
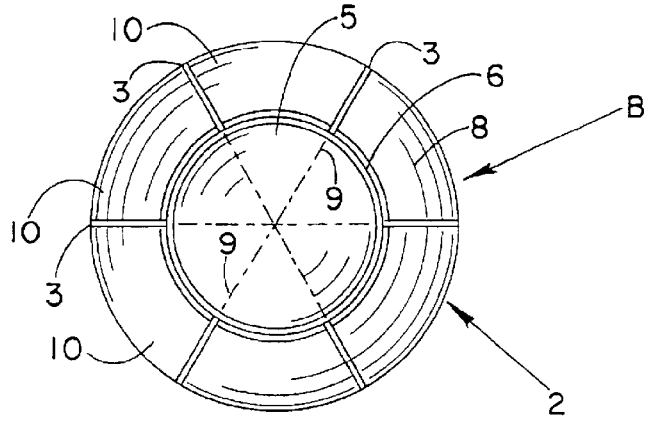
FIG. 5 is a top plan view of the jacket and interior segments of our bullet, formed into its finished.
Figure 6:
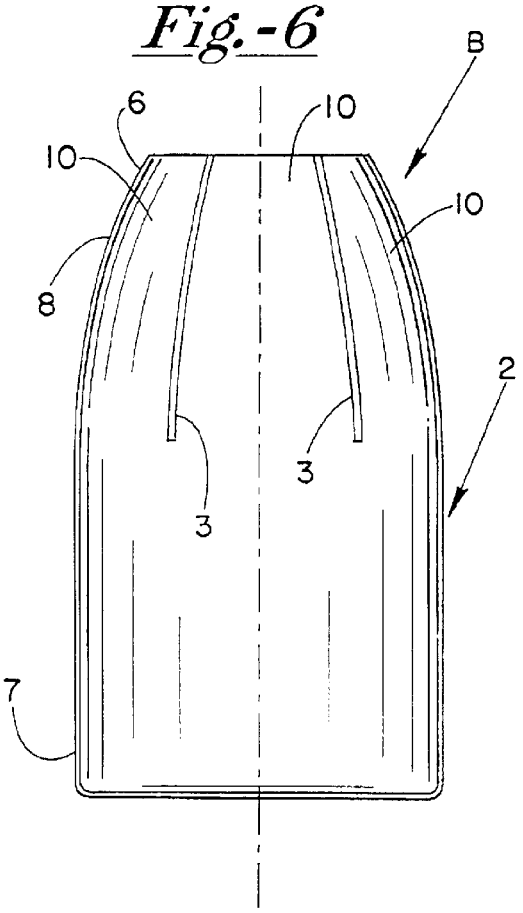
FIG. 6 is a side elevational view of our completed bullet in its finished condition, showing the deep scoring of the jacket and the petals defined thereby.
Figure 7:
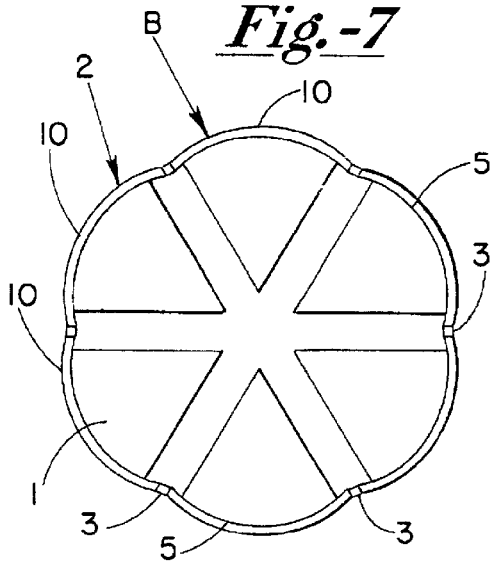
FIG. 7 is a top plan view of the bullet only partially formed, to show the wedges prior to swaging thereof.

As best shown in FIGS. 4 and 6, the deep scores 3 which extend from the forward leading edge 6 of the bullet B rearwardly for a distance of at least half the length of the ogive 8, define a petal or panel 10 between each adjacent pair of scores. As best shown in FIG. 5, each of these petals 10 is circumferentially spaced from the other and is directly opposite and outward of one of the wedge-shaped segments 5. It is noteworthy that this relationship is maintained throughout the expansion process.

It is also noteworthy that the shelf-like support 12 which is offered and produced by the outward movement of the petals 10 in the expanding condition of the bullet, function to arrest the degree of expansion which takes place, and thereby precludes the likelihood of the bullet stopping adjacent its entrance point of the target, rather than proceeding to 12.5–16 inches therewithin, as desired and occurring. Also, the outward disposition of the petals 10 relative to the cylindrical wall of the jacket makes the shelf-like projection 12, which supports the individual, physically separate, wedge-shaped core segments 5, wider than twice the thickness of the cylindrical wall of the jacket, since each petal doubles back rearwardly upon itself, and thereby provides two thickness' of the cylindrical wall, as well as a spacing therebetween.

In the final stages of the bullet forming, the front portion or ogive 8 of the bullet is tapered or pointed by compression known as swaging. This action presses the physically separate wedge-shaped core segments 5 together to form a single body, yet retaining at least some of their individuality through the weakening planes 9. In the same operation, a conically shaped tool is pressed into the end of the front portion of the bullet to form the hollow-point cavity 4 out of the forward-most portions of the wedge-shaped separate core segments 5. The hollow-point cavity 4 is shallow, but very wide, in order to keep the thickness of the core material at the leading edge 6 of the bullet relatively thin. The hollowed point cavity 4, when formed as indicated above, is conical in shape and converges toward the longitudinal axis of the core 1 and has an angle relative to the longitudinal axis of the jacket and bullet within the range of about 30–50 degrees. It is believed that its shallowness is responsible for the manner in which it sheds a portion of whatever barrier material it picks up, either before or as it enters the target of the bullet.

The leading edge 6 of the bullet, when formed as described above, is comprised of a very thin hoop 15 of core 1 material and jacket 2 material as described above relative to edges 13 and 14. This jacket material is weakened by the deep exterior scoring 3. The core material is weakened by the radial weakening planes 9 of the physically separate, wedge-shaped core segments 5 which are formed in the front ogive portion 8 of the bullet and extends substantially parallel to the longitudinal axis of the jacket 2. The above elements form the relatively weak front portion 8 of the bullet by filling the nose to a point adjacent the open end in the form of the hollowed point 4.

As the bullet strikes barrier material, it commences to expand to a limited degree and pierces the barrier, picking up limited amounts of the barrier material and carrying a portion thereof to the target. It is believed that the shallow hollowed point sheds most, if not all, of the barrier material which it is carrying.

Figure 3:
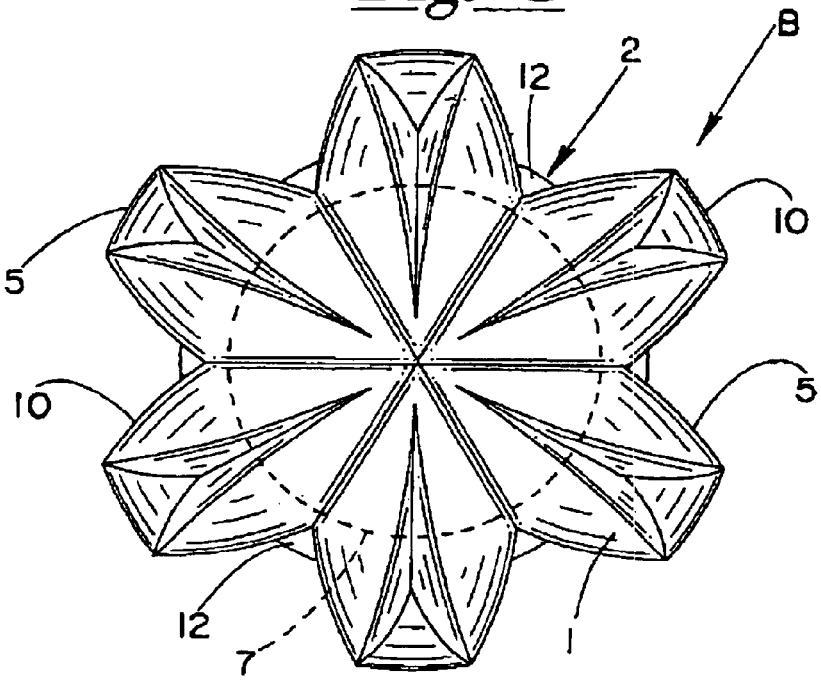
FIG. 3 is a top plan view of our bullet in its fully expanded condition.

Upon impact with the target, the weak front portion 8 of the bullet collapses and expands in response to the pressure created by the impact upon the weakening features. Thus, the expansion develops along the exterior scores 3 in the jacket and along the weakening planes 9 in the core. Having entered the target, it readily collects viscous material, of which there is an abundance within the target, which causes the segments 5 of the core to expand rapidly, rupture the scores, and expand the petals to the position and into the form, shown in FIGS. 3 and 5. Am the bullet expands or mushrooms, the jacket 2 is torn along the exterior scores 3 and this exposes the wedge-shaped core segments 5 within the front portion 8 of the bullet. The petals 10 swing outwardly and the physically separate segments 5, bearing thereagainst, facilitate the continued expansion. This causes the front portion 8 of the jacket to continue to fold along the exterior of the side wall toward the rear portion 7 of the bullet in an arc shape, as shown in FIG. 4, adjacent the shelf-like area 12. The expanded free ends of the petals 10 swing rearwardly to a position closely adjacent to the cylindrical side wall and the expanded core segments 5 extend closely adjacent to their associated but separate petals, once the bullet reaches its full expansion, as described, and as shown in FIGS. 3 and 4. The expanded separate core segments 5, however, are superimposed relative to their associated petals and extend only to the rearward base portion of the petals 10.

When the bullet reaches its optimum expansion, as described above, several features of the bullet stop its deformation and thereby prevent over-expansion or fragmentation. Thus, the jacket 2 which is thicker toward the rear portion of the bullet 7, resists further deformation of the jacket 2 or the bullet core 1. The relatively thick walls of the rear portion 7 of the bullet adjacent the expanded petals 10 and core segments 5, prevent fragmentation and loss in bullet weight.

It is noteworthy that the outward extension of the petals or panels 10 to the position shown in FIG. 4 produces a shelf-like area 12 immediately outwardly of and in cooperation with the vertical side wall of the rear portion of the bullet and each, when expanded, supports its associated wedge-shaped expanded core segment 5. The radial weakening planes 9 of the wedge-shaped segments 5 reduce in size as progress is made toward the rear of the bullet core 1. The smaller size of the weakening planes 9, and the consequent greater strength of the segment thereat, aid in arresting further expansion or deformation of the bullet. The smaller portions of the weakening planes preclude fragmentation of the core and loss of bullet weight. Because of the full expansions which occur within the target, the expanded bullet travels about 12.5–16 inches within the target and does not pass therethrough. The bullet expands radially to about 1.5–2.0 times the diameter of the jacket 2.

Although our bullet utilizes a jacket of variable wall thickness, it is recognized that a bullet utilizing a constant thickness jacket wall will also perform adequately. Likewise, our bullet is preferably formed with deep external scoring in the jacket wall; however, internal scoring will also perform adequately. The optimum orientation of the jacket petals 10 would be to align the weakening planes 9 in the core 1 with the deep scores 3 in the jacket 2. However, if the petals 10 and core segments 45 are not aligned, the bullet still performs adequately, but not to the degree of effectiveness which will result when weakening planes and scores attain alignment.

It will, of course, be understood that various changes may be made in the form, details, arrangement and proportions of the parts without departing from the scope of the invention which comprises the matter shown and described herein and set forth in the appended claims.

What is claimed is:

1. A bullet comprising:

(a) a malleable core having a generally cylindrical one piece base portion and a nose portion, the nose portion having a plurality of physically separate swaged core segments extending forwardly from the base portion and circumferentially arranged about the longitudinal axis of the base portion and cooperatively defining a hollow-point at their forward ends, the swaged separate core segments defining weakening planes between each of the segments;

(b) a jacket formed of a malleable material and surrounding the core, the jacket having a base, a nose and an open forward end, the jacket nose having a plurality of circumferentially spaced scorings where each pair of scorings defines a petal, each of which is separate from and disposed radially opposite and outwardly of one of said segments in cooperative-position to expand radially, and where the weakening planes of the core are aligned with the scorings of the jacket.

2. The bullet of claim 1 wherein the jacket nose has an inner and an outer wall, the scorings positioned on the outer wall.

3. The bullet of claim 1 wherein the jacket nose has an inner and an outer wall, the scorings positioned on the inner wall.

4. The bullet of claim 1 wherein the jacket nose has an inner and an outer wall, the scorings positioned on both the inner and outer walls, the scorings being radially aligned.

5. The bullet defined in claim 1, wherein upon the bullet striking a viscous target, each of the petals is moved outwardly and rearwardly by one of the segments, which greatly expands the radial compass of the bullet.

6. The bullet defined in claim 1, wherein the hollow point is comprised of a cavity having an angled wall the angle of which, relative to the longitudinal axis of the bullet, is within about a 30°–50° range.

7. The bullet defined in claim 1, wherein the jacket has a variable wall thickness which increases from the nose toward the base of the jacket.

8. The bullet defined in claim 1, wherein the hollow point has a generally conical shape.

9. The bullet defined in claim 1, wherein the segments separate along the weakening planes and cause the petals to expand radially, upon the bullet striking a viscous target.

10. The bullet defined in claim 1, wherein the jacket has a uniform wall thickness.

11. The bullet defined in claim 1, wherein the jacket is made principally of a metal taken from a group of metals including copper, aluminum, tungsten, tin, brass, zinc, steel, iron or alloys thereof.

12. The bullet defined in claim 1, wherein the core is made principally of materials taken from a group including lead, tungsten, tin, zinc, polymers, or alloys thereof.

13. The bullet defined in claim 1, wherein the core is mainly polymeric.

14. A bullet for optimal penetration and expansion for law enforcement and personal defense use comprising:

(a) a malleable bullet core having a generally cylindrical one-piece base portion;

(b) said core having a plurality of physically separate radially-expandable, inter-engaging, swaged nose-forming core segments extending forwardly from said base portion and disposed in circumferentially arranged relation about the longitudinal axis of said cylindrical base portion and cooperatively defining a barrier material-shedding hollow-point at their forward ends and said swaged core segment defining weakening planes between each of said segments;

(c) a jacket formed of a malleable material and surrounding said core and having a plurality of adjacent nose-and-mouth-defining petals, each of which is separate from and disposed radially opposite and outwardly of one of said segments in cooperative-position to expand radially; and (d) said petals being defined by a plurality of circumferentially spaced deep scorings in said jacket which extend longitudinally of said jacket and wherein the weakening planes of the core are aligned with the scorings of the jacket.

15. The bullet defined in claim 14, wherein upon said bullet striking a viscous target, each of said petals is moved outwardly and rearwardly by one of said segments, which expands the radial compass of the bullet.

16. The bullet defined in claim 14, wherein said hollowed point is comprised of a cavity having an angled wall the angle of which, relative to the longitudinal axis of said bullet, is within about a 30°–50° range.

17. The bullet defined in claim 14, wherein said jacket has a forward end and a rearward portion and a variable wall thickness which increases from said forward end toward the rearward portion of said jacket.

18. The bullet defined in claim 14, wherein said hollowed point has a generally conical shape.

19. The bullet defined in claim 14, wherein said jacket includes a cylindrical wall and further wherein upon said bullet striking a viscous target, said segments and said petals expand radially to a point at least adjacent the forward-most area of said cylindrical wall.

20. The bullet defined in claim 19, wherein said jacket has a uniform wall thickness.

21. The bullet defined in claim 14, wherein said segments separate along said weakening planes and cause said petals to expand radially, upon said bullet striking a viscous target.

22. The bullet defined in claim 14, wherein said jacket is made principally of a metal taken from a group of metals including copper, aluminum, tungsten, tin, brass, zinc, steel, iron or alloys thereof.

23. The bullet defined in claim 14, wherein said core is made principally of materials taken from a group including lead, tungsten, tin, zinc, polymers, or alloys thereof.

* * * * *